United States Patent [19]

Yeffman

[11] Patent Number: 4,974,493

[45] Date of Patent: Dec. 4, 1990

[54] SHOCK ABSORBING BUFFER AND RECOIL REDUCER

[76] Inventor: Paul L. Yeffman, 911 Sligo Creek Pkwy., Takoma Park, Md. 20912

[21] Appl. No.: 286,741

[22] Filed: Dec. 20, 1988

[51] Int. Cl.[5] ..... F41A 3/78

[52] U.S. Cl. ..... 89/198

[58] Field of Search ..... 89/177, 196, 198, 163, 89/198, 196, 44.01, 44.02

[56] References Cited

U.S. PATENT DOCUMENTS

| | | | |
|---|---|---|---|
| 168,346 | 10/1875 | Schultz | 89/44.02 |
| 834,578 | 10/1906 | Johnson | 89/198 |
| 1,563,675 | 12/1925 | Tangley | 89/196 |
| 1,646,699 | 10/1927 | Loomis | 89/198 |
| 3,501,997 | 3/1970 | Winsen et al. | 89/44.02 |
| 3,662,648 | 5/1972 | Maillard | 89/44.02 |
| 3,756,121 | 9/1973 | Roy | 89/196 |
| 3,893,369 | 7/1975 | Benelli | 89/182 |
| 3,901,125 | 8/1975 | Raville | 89/163 |
| 3,982,468 | 9/1976 | Browning | 89/193 |
| 4,042,442 | 8/1977 | Dombroski et al. | 156/310 |
| 4,181,644 | 1/1980 | Lehr | 524/505 |
| 4,317,737 | 3/1982 | Oswald et al. | 252/28 |
| 4,344,352 | 8/1982 | Yates et al. | 89/198 |
| 4,463,655 | 8/1984 | Krieger | 89/196 |
| 4,522,107 | 6/1985 | Woodcock et al. | 89/196 |
| 4,754,689 | 7/1988 | Grehl | 89/198 |
| 4,833,808 | 5/1989 | Strahan | 42/1.06 |

FOREIGN PATENT DOCUMENTS

| | | | |
|---|---|---|---|
| 252941 | 12/1911 | Fed. Rep. of Germany | 89/196 |
| 526759 | 10/1921 | France | 89/196 |
| 115512 | 5/1918 | United Kingdom | 89/44.01 |
| 521272 | 5/1940 | United Kingdom | 89/44.02 |

*Primary Examiner*—Charles T. Jordan
*Assistant Examiner*—Stephen Johnson

[57] ABSTRACT

An automatic pistol having a slide reciprocably mounted on a frame and having a plastic buffer member mounted between the pistol slide and barrel for absorbing slide impact between the slide and the frame.

1 Claim, 1 Drawing Sheet

SHOCK ABSORBING BUFFER AND RECOIL REDUCER

BACKGROUND OF THE INVENTION

1. Field of the Invention

This invention relates to automatic and machine pistols and particularly to an impact buffer member for absorbing recoil energy and for reducing frame fatigue caused by the impact of the pistol slide.

2. Description of the Prior Art

Various expedients have been used in an attempt to dampen the shock impact when a pistol has been fired. For example: U.S. Pat. No. 1,646,699 shows a disc of fiber attached to a frame of a firearm by means of a screw. U.S. Pat. No. 3,756,121 shows a combination guide rod and recoil buffer made of nylon resins. U.S. Pat. No. 4,344,352 shows a resilient cap mounted on recoil springs. U.S. Pat. No. 4,522,107 shows a shock-absorbing mechanism including a pair of rigid plates positioned on opposite sides of a resilient sheet of energy dissipating material such as polypropylene. U.S. Pat. No. 4,754,689 discloses a plastic spring guide made of an acetal resin thermoplastic polymer made by the polymerization of formaldehyde. While such previous shock absorbing means may have been successful when exposed to reasonable recoil impacts, materials previously selected have not been able to withstand the high temperatures and pressures of modern automatic and machine pistols.

In the design of automatic and machine pistols, particularly where concealment is critical, space limitations and material availability has made it impractical to include anything but a minimal buffering system. The conventional weapons designs used today have a higher rate of recoil and metal fatigue due to various types of alloys and ammunition, weight of bullet, or types of propellant, or both now being utilized in this art.

This recoil of parts, such as the slide of a pistol or the bolt of a machine pistol results in the pounding of metal abutments out of shape and in some weapons metal fatigue and complete failure, causing the weapon to become inoperative or resulting in total failure of parts causing the weapon to crack or destruct without warning. This problem has resulted in numerous buffer recoil designs which have attempted to provide adequate dispersion of recoil energy without creation of a bulky or costly manufacturing process during original weapon design. It has also created numerous add-on designs to reduce recoil or weapon parts fatigue after the weapon has been put into service, the result being that these conventional shock absorber type systems do not generally provide the recoil impact reduction necessary to stop these occurrences.

Accordingly, it is an object of this invention to provide a compact means for buffering recoil energy in automatic pistols and machine pistols.

Another object is to provide a buffering means which may be incorporated in new pistols or may be retrofitted to existing pistols.

A further object is to provide a buffering means which is relatively inexpensive, easy to manufacture, and easily installed.

DESCRIPTION OF THE DRAWINGS

These and other objects of the invention will become more readily apparent from the following detailed description, when taken in conjunction with the accompanying drawings.

DETAILED DESCRIPTION OF THE INVENTION

Figure 1:
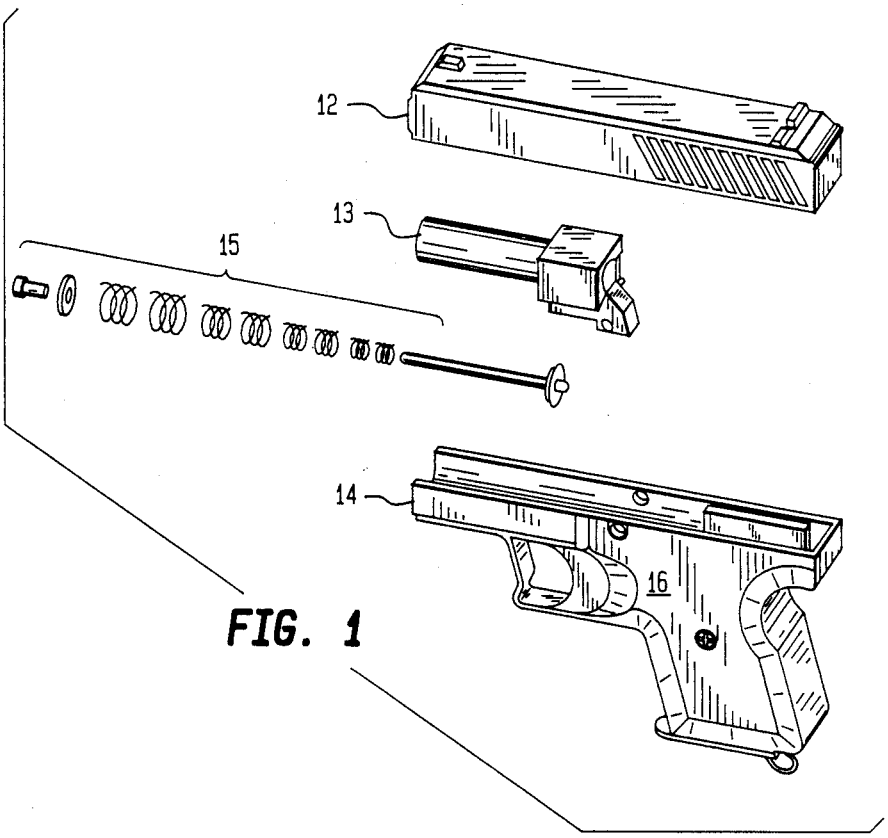
FIG. 1 is an exploded isometric view of an automatic pistol illustrating the slide, recoil mechanism, barrel and frame.
Figure 2:
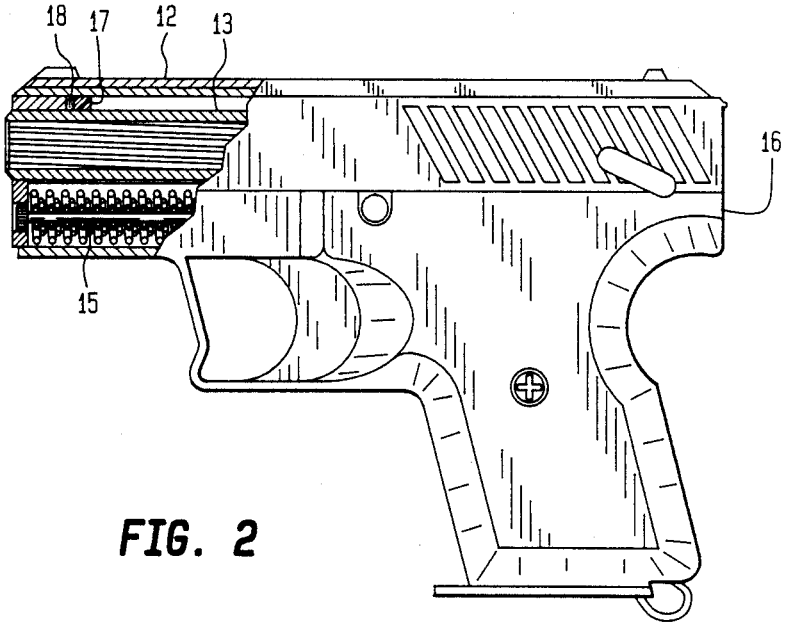
FIG. 2 is a fragmented side elevational view of the automatic pistol.

Referring to the drawings, an automatic pistol 10 is illustrated. Pistol 10 has a frame body 16 including slide guides 14 on which is mounted slide number 12 for reciprocation upon firing of the pistol. Barrel 13 is mounted on frame 16 and remains relatively stationary with respect to said frame upon reciprocation of the slide 12. Also mounted on frame 16 is the recoil spring assembly 15. Since the spring assembly 15 is not fully effective to absorb the recoil forces, the slide 12 will impact on a portion of the barrel or frame assembly upon firing of the pistol. Unless the force of the impact is absorbed, upon sustained firing or over the life of the pistol, such impact force will either buckle the frame or cause bowing at the locking portions of the slide, depending on the type of pistol We have found that mounting a shock absorbing means between the slide and the frame will overcome the bowing of the slide or the buckling of the frame of conventional automatic and machine pistols and will improve accuracy by the reduction in recoil force. In the preferred embodiment of our invention, an insert 17 is interposed between the slide 12 and the barrel or the frame by means of an adhesive 18, depending on the design of the pistol assembly 13. The buffer insert 17 is preferably a ultra high molecular weight polyethylene (UHMWPE) having a Rockwell hardness rating of R-50, or a high molecular weight polyethylene (HMWPE) having a shore hardness rating of D63 to D65. Ultra high—molecular weight polyethylenes (UHMWPE) have been defined by ASTM as "those linear polyethylenes which have a relative linear viscosity of 2.3 or greater, at a solution concentration of 0.05% at 135° C. in decahydronaphthalene." Page 67 —Modern Plastics Encyclopedia, 1986–1987. High molecular high density polyethelene (HMWPE) usually is defined as an ethylene polymer with a density of 0.941 g/cc or greater and a Melt Flow of 1 to 20 when measured by Condition 190/21.60 of ASTM D1238, Page 63 Modern Plastics Encyclopedia 1986–1987. Such polyethylene copolymers are manufactured by the American Hoechst Corp., Specialty Products Group, Somerville, N.J. This insert 17 is bonded to either the inside of the front of the slide 12 or the barrel assembly 13 or the frame 16 by an adhesive 18. An adhesive which has been found to bind JHMWPE or HMWPE to metal is cyanoacrylate adhesive composition containing elastomeric polymers as fillers and sold by Loctite Corporation, Newington, Connecticut, under the trade mark "Black Max." In addition to the polyethylene described above, polypropylene, polyolefin or polyurethane, or other copolymers that are resiliant and relatively non-deformable may be used as a buffer material. This buffer or shock absorbing means may be installed on a variety of pistols. It is inexpensive and may be originally incorporated in the pistol or retrofitted without altering the operating characteristics of the weapon.

A preferred embodiment has been described to illustrate the principle of the invention but it is to be understood that modifications may be made without departing from the scope or spirit of the invention as defined in the claims.

We claim:

1. An automatic weapon comprising a frame, a barrel mounted on said frame, a slide having a front face and sides, said slide mounted on said frame for reciprocating movement relative to said frame and said barrel upon firing of said weapon, a resilient plastic member for absorbing shock caused by recoil impact of said slide with said frame upon firing of said weapon, and means for mounting said resilient plastic member between said slide and said frame on an inside surface of the front face of said slide, wherein said resilient plastic member is a polyethelene and said means for mounting said resilient member is a cyanoacrylate adhesive.

* * * * *